United States Patent [19]

Kuehfuss

[11] Patent Number: 4,558,557

[45] Date of Patent: Dec. 17, 1985

[54] APPARATUS FOR AUTOMATICALLY CONVERTING PILES OF FRESHLY PRINTED SHEETS OF VALUE TOKENS, IN PARTICULAR SHEETS OF BANK NOTES, INTO BUNDLE PACKS

[75] Inventor: Runwalt Kuehfuss, Lausanne, Switzerland

[73] Assignee: De La Rue Giori S.A., Switzerland

[21] Appl. No.: 434,887

[22] Filed: Oct. 18, 1982

[30] Foreign Application Priority Data

Oct. 22, 1981 [CH] Switzerland ..... 6740/81

[51] Int. Cl.[4] ..... B65B 27/08

[52] U.S. Cl. ..... 53/506; 53/507; 53/520; 53/590

[58] Field of Search ..... 53/54, 520, 505, 506, 53/507, 589, 591, 590

[56] References Cited

U.S. PATENT DOCUMENTS

| | | | |
|---|---|---|---|
| 3,939,621 | 2/1976 | Giori | 53/54 X |
| 4,045,944 | 9/1977 | Giori | 53/520 |
| 4,283,902 | 8/1981 | Giori | 53/520 X |

*Primary Examiner*—James F. Coan

*Attorney, Agent, or Firm*—Darby & Darby

[57] ABSTRACT

The apparatus has a strip cutting device (6) in which the sheet piles (1) are cut into bundle strips (8), a bundle cutting device (16) for cutting the bundle strips into banknote bundles (17) and therebetween a banding station (9) for the bundle strips (8). This banding station (9) has as many synchronously operating banding devices (*9a, 9b, 9c, 9d*) as there are banknote positions per strip and a band detector system (30,31,32) which indicates the absence of a band (10) or an incorrectly performed banding operation by means of a fault signal which switches off the apparatus. Simultaneously an indication is given at which individual banding device (*9a, 9b, 9c, 9d*) the fault has occured. Each of these banding devices can be set in operation by means of an associated switch member (*34a, 34b, 34c, 34d*) for carrying out an individual late banding operation. Then the apparatus can be restarted to continue the automatic operation. Thus when a banding fault occurs the bundle strip (8) does not have to be removed from the banding station (9) and correction of the fault by individual late banding operations requires only a brief interruption of the operation of the apparatus.

3 Claims, 8 Drawing Figures

APPARATUS FOR AUTOMATICALLY CONVERTING PILES OF FRESHLY PRINTED SHEETS OF VALUE TOKENS, IN PARTICULAR SHEETS OF BANK NOTES, INTO BUNDLE PACKS

The invention relates to apparatus for automatically converting piles of freshly printed sheets of value tokens, in particular sheets of bank notes, into bundle packs.

It has been previously proposed to provide apparatus for automatically converting piles of freshly printed sheets of multiple numbered value tokens, in particular sheets of bank notes, into packs of banded bundles of consecutively numbered value tokens, the apparatus comprising a strip cutting device for cutting the piles into bundle strips, a banding station for the bundle strips comprising as many banding devices, arranged adjacent one another and operating in synchronism, as there are individual value tokens per strip, a bundle cutting device for cutting the banded bundle strips into banded bundles, an intermediate store in which bundles containing value tokens of the same series are piled into bundle packs, and advancing and transporting devices for the piles, bundle strips and bundles.

An apparatus of this previously proposed kind is known from CH-PS No. 612639 by the same applicant, corresponding to GB-PS No. 1 547 734 and U.S. Pat. No. 4,283,902. These specifications describe particularly the arrangement of the cutting device and the banding station in which the bundle strips are provided before division into bundles of notes with as many strips as there are banknotes per strip so that the bundles of notes arriving in the bundle cutting device are already banded.

A similar apparatus, but without the aforementioned multiple banding station, is described in CH-PS No. 577426 by the same applicant, corresponding to DE-PS No. 2502987 and U.S. Pat. Nos. 3,939,621 and 4,045,944, particular reference being had to the intermediate store comprising two similarly constructed magazine drums having peripherally distributed magazines in each of which a predetermined number of banknote bundles of the same numerical series forming a bundle pack is piled on rotation of the drums.

As described in the specifications cited above, at the outlet of a numbering machine which numbers the banknote prints on a multiple banknote sheet, piles of generally one hundred sheets are formed so that after cutting the pile bundles containing one hundred banknotes respectively are produced. Every ten bundles, totalling one thousand consecutively numbered banknotes, are then automatically combined into a pack of one thousand banknotes. However, since all the banknote prints on a sheet, the so-called banknote positions, belong to different series and the superimposed banknote positions in one pile of sheets are consecutively numbered to form a respective series, the bundles of banknotes cut to size and leaving the cutting machine need to be rearranged before being packed into packs. In this rearrangement all the first bundles of ten successive piles of sheets, then all the second bundles of the ten successive piles of sheets, and so forth, are piled into packs which then contain one thousand successively numbered banknotes in ten bundles. This automatic rearrangement takes place in an intermediate store which, as previously mentioned, preferably comprises two similarly constructed magazine drums of which a respective one is supplied with bundles of banknotes until it is completely full while the other previously filled drum is unloaded in stepwise manner whereby the bundle pack is pushed out of each full magazine and fed to the packing machine. An automatic distribution device arranged in front of the two magazine drums ensures that after one drum has been completely filled the following bundles are supplied without interruption to the other drum which has meanwhile been emptied.

The banding station provided between the strip cutting device and the bundle cutting device has the advantage that all the bundles belonging to one bundle strip are banded simultaneously and consequently the bundles of banknotes leaving the final cutting device are already banded. This avoids the bottleneck caused by the maximum operating speed of the conventional single banding station used in older converting apparatus downstream of the final cutting device. In this case the bundles of banknotes, which have already been cut to size, are banded individually one after the other. This individual banding operation, requiring at least about two seconds, represented the slowest working step to which all other working speeds had to be adapted. Now that all the bundles of banknotes belonging to a bundle strip, i.e. depending on the type of sheet, generally four to eight bundles, are banded simultaneously, the capacity of the entire processing apparatus when using the aforementioned multiple banding station can be increased to about the capacity of modern printing and numbering machines for banknotes, i.e. to a processing speed of four hundred thousand to five hundred thousand banknotes per hour, depending upon the number of banknote positions per sheet. Moreover, the banding devices that are used do not in principle require to work at the maximum possible speed so that their wear and breakdown rate is reduced. A further advantage of introducing the aforementioned multiple banding station is that the banknotes that are cut to size are only accessible to service personnel in the form of banded bundles thus practically precluding possible theft of individual banknotes.

The known multiple banding station having up to eight separate commonly controlled banding devices with individual band supply has however been unable to guarantee ideal operation because when a banding fault occurs the whole converting apparatus automatically shuts down for a substantial time. First of all the bundle strip at which a band is absent or has not been or has been improperly secured, is removed from the apparatus by hand, is correctly banded by means of an auxiliary banding device and then returned to its correct location in the apparatus before the converting apparatus can be restarted to resume operation. Experience has found that such banding faults, caused particularly by difficulties in the paper supply or in carrying out the banding operation, must always be expected, the most frequent fault being non closure of a band intended to be laid around the bundle strip. The relatively long down times hitherto required as a result of such comparatively harmless faults substantially reduce the operating capacity of the converting apparatus which typically would permit processing of four hundred and eighty thousand banknotes per hour.

The object of the invention is therefore to construct the banding station in an apparatus of the kind described above in such a way that when a banding fault occurs the down time of the apparatus necessary for rectifying this fault is limited to a minimum time, normally only a few seconds, whereby the operating capacity of the apparatus is barely reduced even when banding faults do occur.

According to the invention there is provided apparatus for automatically converting piles of freshly printed sheets of multiple numbered value tokens, in particular sheets of banknotes, into packs of banded bundles of consecutively numbered value tokens, the apparatus comprising a strip cutting device for cutting the piles into bundle strips, a banding station of the bundle strips comprising as many banding devices, arranged adjacent one another and operating in synchronism, as there are individual value tokens per strip, a bundle cutting device for cutting the banded bundle strips into banded bundles, an intermediate store in which bundles containing value tokens of the same series are piled into bundle packs, and advancing and transporting devices for the piles, bundle strips and bundles, wherein the banding station is associated with a band detector system, which is adapted to sense an absent band or a faulty banding operation and, before further movement of the respective bundle strip, to emit a fault signal whereby the fault position is identified and the operation of the section of apparatus including the cutting devices, the banding station, the intermediate store and the aforementioned advancing and transporting devices is interrupted, and wherein each banding device is individually operable and is provided for that purpose with an actuating element which after the occurrence of a fault signal is actuatable manually or automatically for the purpose of carrying out an individual late banding operation by means of the respective banding device.

By this means is achieved not only that an absent band strip or a faulty, particularly an unclosed strip, is automatically reported by the detector system and the apparatus, insofar as its parts are affected by the delay at the banding station, is switched off, but also that immediately after this signal the bundle strip can be late banded at the appropriate location by the respective individual banding device. The control of the respective banding device is generally carried out manually by the person monitoring the operation, whereupon in the case of a faulty band the unclosed band is removed. Thus in order to correct the faults the affected bundle strip does not need to be removed from the banding station and rectification of the fault generally takes no longer than ten to twenty seconds if the operator reacts quickly and no other fault has to be corrected in the banding station. The apparatus is then restarted and the normal operation can resume.

The arrangement may also be such that at least in the case of the absence of the band strip the late banding operation and the subsequent restaring of the apparatus take place automatically.

The above described technical advantage can be achieved at little additional cost in terms of control means since band detectors for the purpose of monitoring the correct banding are required in any event and the known banding station only requires to be modified insofar as each individual banding device must be capable of separate operation if required to carry out an individual banding operation.

The invention is further described with reference to the drawings showing an embodiment. In the drawings.

Figure 1:
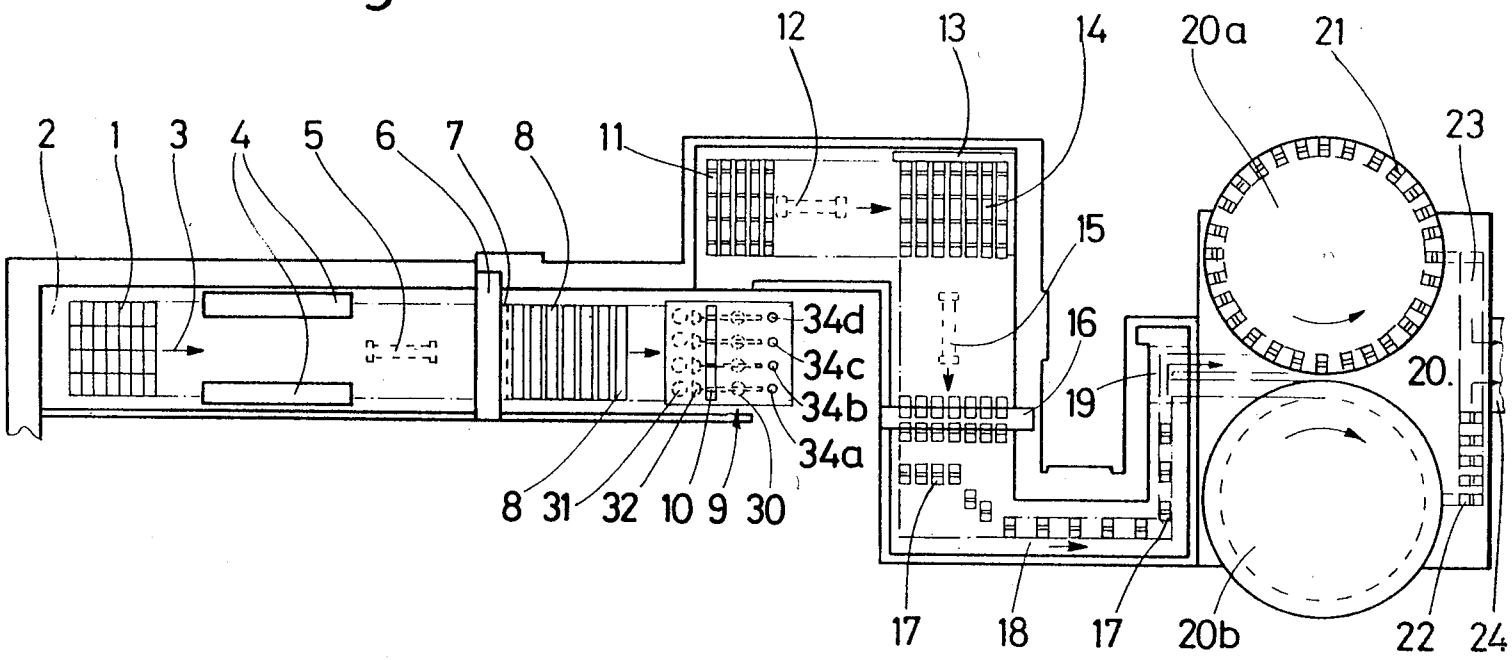
FIG. 1 is a schematic view of the apparatus according to the invention.
Figure 2:
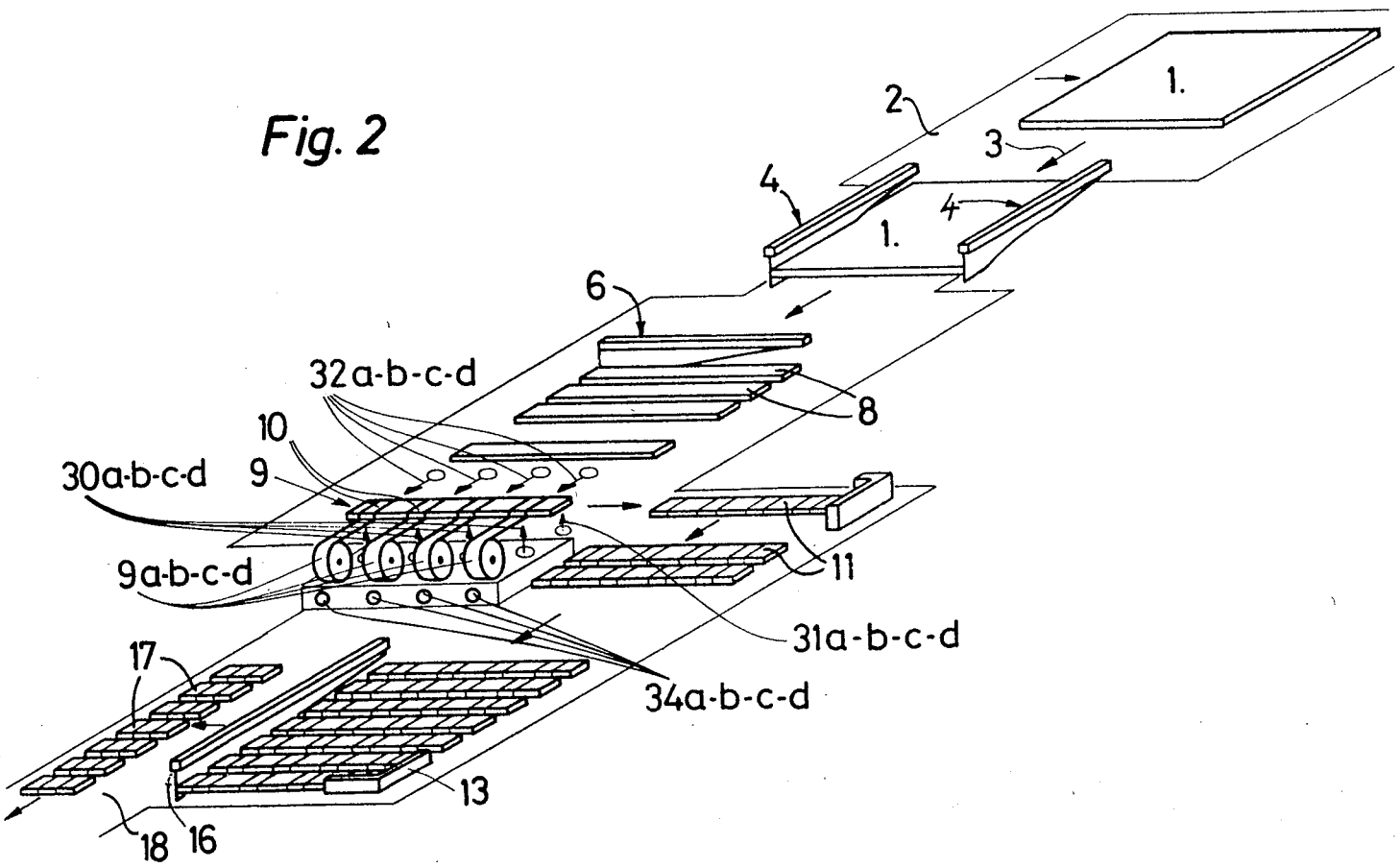
FIG. 2 is a schematic perspective representation of the apparatus according to FIG. 1, without the intermediate store.

The apparatus according to FIGS. 1 and 2 processes piles 1 each of one hundred sheets which have passed through a banknote printing and numbering machine and are therefore printed with numbered banknote prints, so-called banknote positions. The sheet pile 1, in which the sheets are arranged in the correct numerical sequence, arrives at the work table 2 of an automatic cutting machine. In the illustrated example each sheet has twenty-eight banknote positions arranged in grid-like fashion in seven rows extending transversely of the feed direction and in four ranks extending in the feed direction. The bank note positions that are superimposed in each pile of sheets belong to a predetermined numerical series and are numbered consecutively within this series.

The automatic cutting machine has two parallel opposed longitudinal slitting devices 4 with blades oriented in the feed direction for edge trimming and two cross cutting devices with blades oriented perpendicularly to the feed direction, namely a strip cutting device 6 for strip cutting and a bundle cutting device 16 for bundle cutting. The pile 1 is fed in the direction of the arrow 3 to the longitudinal slitting devices 4 the blades of which simultaneously cut the lateral sheet edges of each pile. The pile 1 then arrives at the cross cutting device 6 by means of an electronically programmable feeder 5. Here an edge cut is first made at the front side of the pile, the pile is then divided stepwise into seven bundle strips, and finally rear edge trimming is carried out on the rear side of the last bundle strip. The paper off-cuts fall through a waste flap 7. After a pile has been divided the next pile is automatically supplied.

Behind the strip cutting device 6 is a banding station 9 having as many individual banding devices arranged next to one another in a row as there are banknote positions per strip, i.e. in the illustrated case there are four banding devices, 9*a*, 9*b*, 9*c* and 9*d* which are operated in synchronism in each working step. The bundle strips 8 arrive one after the other at the banding station 9 and are simultaneously encircled at the fourth banknote positions with a respective pre-gummed band 10. The banding station 9 is fitted with three groups of band detectors 30, 31 and 32 having detectors 30*a*, 31*a* and 32*a*; 30*b*, 31*b* and 32*b*; 30*c*, 31*c* and 32*c* or 30*d*, 31*d*, and 32*d* associated with the individual banding devices 9*a*, 9*b*, 9*c* and 9*d*, the function of the detecors being described below. Moreover each individual banding device 9*a*, 9*b*, 9*c* and 9*d* is associated with an individual switch member 34*a*, 34*b*, 34*c* and 34*d*, for example in the form of a push button, so that at any time a selected one or more of the banding devices may be individually actuated for carrying out a banding operation.

The finished banded bundle strips 11, as illustrated by arrows, are first removed from the banding station 9 in the longitudinal direction of the strip and then, after changing the feed direction through 90°, fed transversely to the longitudinal direction of the strip to a position 13 by means of a further electronically programmable feeder 12. From there the seven bundle strips 11 belonging to the same pile 1 are collected, arranged and combined into a group 14. This group 14 of seven adjacent bundle strips is advanced at the same time by means of an electronically programmable feeder 15 to the bundle cutting device 16 where all seven bundle strips 11 are simultaneously cut in stepwise fashion into individual, ready-banded bundles 17. In the illustrated example three cuts are necessary since each strip has four banknote positions.

The banded bundles 17 which have been cut to size are automatically advanced to a feed path 18 on which they arrive in predetermined spaced relationship one behind the other at a distributing station 19 and then in the intermediate store 20 comprising two similarly constructed magazine drums 20*a* and 20*b*. Distributor station 19 and intermediate store 20, as well as their functions, are described in CH-PS No. 577426 by the same applicant, as already mentioned above. Each of the magazine drums 20*a* and 20*b* has peripherally distributed magazines 21 and rotates in the direction of the arrow uniformly and at such a speed that the twenty eight bundles 17 belonging to the same original pile 1 fall one after the other into twenty-eight different magazines 21 of one drum, in the example according to FIG. 1 in the drum 20*a*, during one complete revolution of the drum and the following bundles 17 deriving from the next pile arrive during the following drum rotation in the same magazines 21, and so on. In this way all the bundles 17 deriving from ten successive piles 1 and having the same banknote positions on the sheets, are piled one above the other in one of the magazines 21 of the magazine drum 20*a* until ten bundles have been collected in the respective magazine. Because the numbering machine, which numbers the sheets before forming the pile 1, numbered the same banknote positions on successive sheets consecutively within a series, the one thousand banknotes have all the bundles 17 in a so-formed bundle pack 22 comprising ten bundles each belong to the same series and are consecutively numbered.

After completely filling the magazine 21 of the one magazine drum 20*a* the following bundles 17 in the distribution station 19 are automatically directed to the other magazine drum 20*b* where the described rearrangement repeats itself. At the same time the full magazine drum 20*a* is unloaded in stepwise manner in that, as illustrated in FIG. 1 for the other drum 20*b*, the bundle packs 22 are successively pushed out of each magazine 21 and delivered to a transport section 4 by a conveying system 23. On this transport section 24 there takes place the further processing of the bundle packs 22 which after again being counted are automatically banded and packaged.

Figure 6:
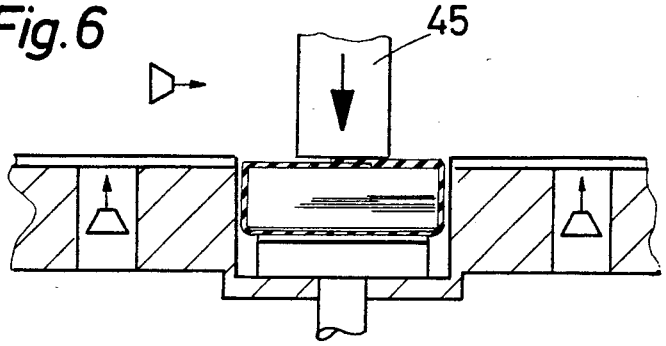
Figure 7:
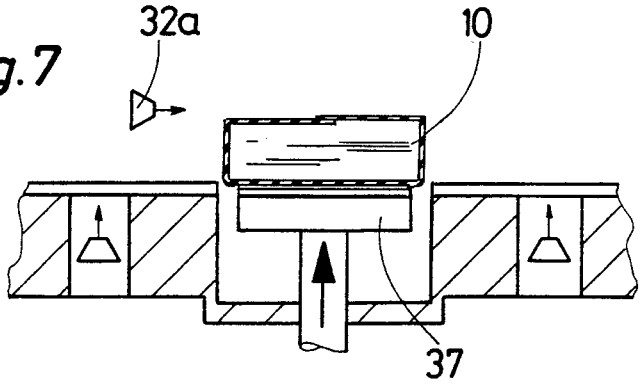
Figure 8:
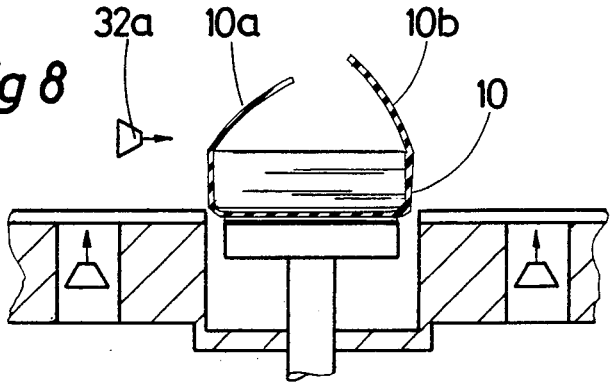

The function of the band detector system, which in the illustrated embodiment operates with photoelectric detectors, is described below with reference to FIGS. 3–8, whereby FIGS. 3–7 illustrate five successive steps in the banding of one location of a bundle strip 8 and FIG. 8 illustrates a faulty banding operation. The photoelectric detectors are conventional detector units in which the light source and photodetector are contained in one housing and the photodetector responds to light of a specific colour or wavelength reflected from the illuminated banding paper. For this purpose the banding strips may be provided at the location to be monitored with corresponding coloured or black markings.

Figure 3:
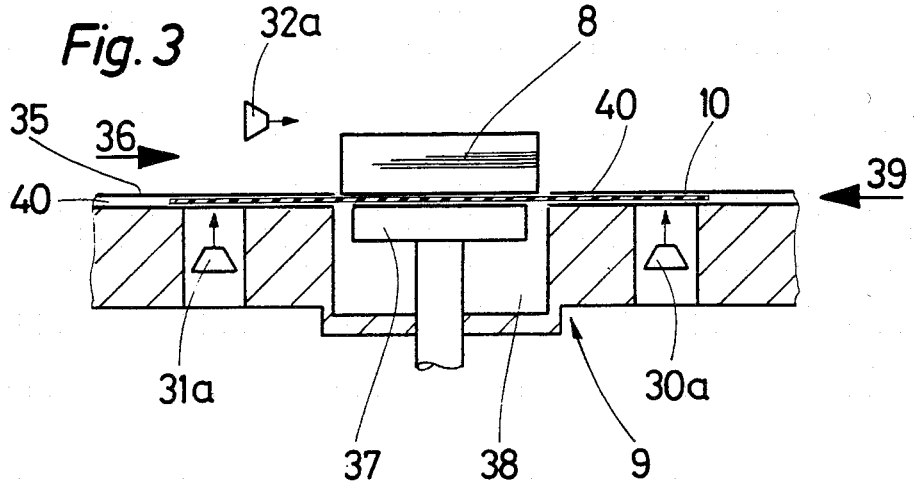
FIGS. 3 to 8 are schematic representations of the banding operation to illustrate the fault recognition.

The photoelectric detectors of the detector groups 30 and 31, of which only a respective detector 30*a*, 31*a* is shown in FIG. 3, monitor the correct supply of the banding strip. A bundle strip 8 arriving at the banding station 9 is pushed on the table 35 in the direction of the arrow 36 on to a plate 37 separate from the table 35 and then arrested. The plate 37 lies above a chute 38 which extends transversely of the feed direction over the entire length of the bundle strip 8 and of which the cross section corresponds to that of the bundle strip 8. After the bundle strip 8 has arrived on the plate 37 the pre-gummed banding strips, with the aid of longitudinally displaceable tongs not shown, are pulled off their supply rollers and beneath the bundle strip 8 in the direction of the arrow 39. For this purpose the upper surface of the table 35 and the plate 37 are provided with corresponding longitudinal grooves or recesses 40 in which the tongs and banding strips can be pushed under the bundle strip 8 until the banding strips have reached their predetermined position as required for the subequent banding operation, whereupon they are cut off to the correct length by means of a cutting device, not shown.

FIG. 3 shows a severed band 10 correctly positioned for a subsequent banding operation. The detectors 30*a* and 31*a*, whose monitoring direction is vertically upwards, are installed below the groove 40, i.e. the band 10, at such spacing at both sides of the bundle strip 8 that they are covered by the ends of this band 10 as illustrated in FIG. 3. The monitoring operation takes place in this situation whereby both detectors 30*a* and 31*a* respond to the presence of the correctly disposed band 10 which in this case signifies faultless operation. If however no band 10 is present at the appropriate time or a band is present but is too short or is not correctly positioned, then at least the detector of one detector group will not respond so causing a fault signal.

FIG. 3 also shows the position of the detector 32*a* of the third detector group 32 which—as described below—controls whether the band encircling the bundle strip 8 is correctly sealed or not. The detector 32*a* is arranged above and to one side of the bundle strip 8 perpendicularly above the respective band 10 and its monitoring direction extends parallel to the upper surface of the bundle strip.

Figure 4:
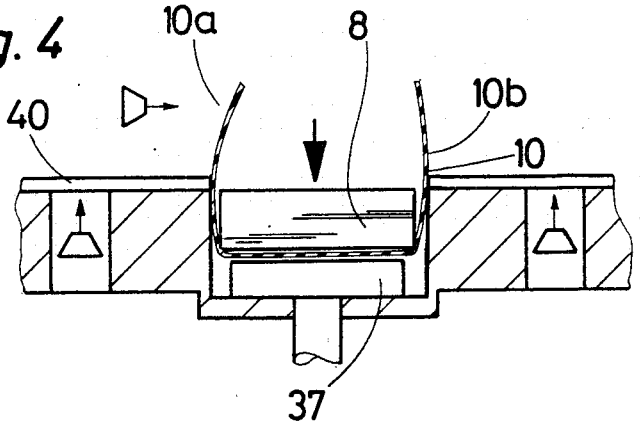

FIG. 4 shows the following step in the banding operation. The plate 37 with the bundle strip 8 thereon is lowered in the chute 38 in the direction of the arrow whereby a plunger, not shown, presses on the bundle strip 8 in order to ensure complete lowering thereeof in the chute 38. The band 10 under the bundle strip 8 is thus also pushed into the chute 38 so that its two end regions extending beyond the width of the bundle strip 8 are folded upwardly at right angles as illustrated in FIG. 4. The two ends 10*a* and 10*b* of the bank 10, which is pre-gummed in these end regions, now extend upwardly over the plane of the table. In order that the band 10 may lie properly against the underside of the bundle strip there may be provided on the floor of the chute 38 projecting abutments engaging in openings of the groove floor or in the recesses of the plate 37 and on which the bundle strip 8 rests in its lowermost position to clamp the bank 10.

Figure 5:
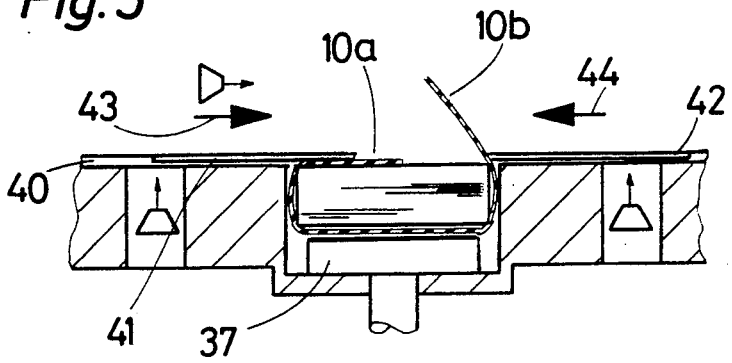

Next come into successive operation two slides 41 and 42 which are preferably fixed to the aforementioned band tongs and are horizontally displaced thereon at the level of the upper surface of the bundle strip 8 whereby the band ends 10*a* and 10*b* are overlapped on the bundle strip 8 as illustrated in FIG. 5. In this operation the one slide 41 is first temporarily advanced on the one side of the bundle strip 8 in the direction of the arrow 43, whereby the one end 10*a* is folded over, and then the other slide 42 is temporarily displaced on the other side of the bundle strip in the direction of the arrow 44 whereby the other end 10*b* is folded over. Then, as shown in FIG. 6, a heated plunger 45 is lowered onto the folded overlapping band ends and effects heat sealing of these pre-gummed band ends. The plate 37 with the fully banded bundle strip 8 thereon is now raised back to the level of the table 35 and in this position illustrated in FIG. 7 is carried out the monitoring operation of the detector 32*a* which determines whether the band ends have in fact been folded and sealed. On proper banding, as shown in FIG. 7, the detector 32*a* does not respond, signifying faultless operation, and the banded bundle strip is pushed out of the banding station 9 as already described.

If however no sealing of the band ends has been effected, because either no adhesive was applied or the predetermined locations were displaced or the heat sealing did not function for whatever reason, then the upstanding or upwardly unfolded ends 10*a* and 10*b* of the band 10 are detected by the detector 32*a* which responds and thus emits a fault signal. This case is shown in FIG. 8.

When a fault signal occurs an optical and/or acoustic alarm is given and at the same time the apparatus is switched off insofar as concerns the stepwise operation or feed and transport affected by the interruption of operation at the banding station 9. That is to say all cutting devices 4, 6 and 16, the drive of the magazine drums 20*a* and 20*b* and the advance or transport of the pile 1, the bundle strips 8 or 11 and the bundles 17 are switched off. At the same time, the emitted fault signal locates and defines that banding device at which the fault has occurred which may be effected by means of a lamp illuminated at the respective banding device. The person monitoring the operation now only needs to actuate the respective switch member 34*a*, 34*b*, 34*c* or 34*d* in order to bring into the operation the appropriate banding device which will then immediately carry out a late banding operation. The faulty band may previously have to be removed by hand. The operator can then immediately start the apparatus again so that the down time resulting from a banding failure generally only requires a few seconds, typically only 10–20 seconds.

After switching off the apparatus, on occurrence of a fault as a result of the absence of the banding strip, there may also be provision for the automatic initiation of the late banding operation by the appropriate banding device and subsequent automatic restarting of the apparatus, which further simplifies the fault removal and reduces the time taken. Such considerable automation can easily be realised in the aforementioned case because no faulty open band needs to be removed. If after one or more repetitions of the fault signal there is still no band paper present the apparatus remains switched off in order that the fault in the band supply can be removed.

In principle it is also possible in the case of an unsealed band to automatically remove the faulty band by suitable grippers so that theoretically even in this case an automatic late banding operation and automatic restarting of the apparatus are possible.

Experiments have shown that in practice it may suffice in monitoring the presence of the band strip to provide only one detector group 31 whose detectors monitor whether the band end remote from the supply roll has been pulled into the correct position by the band tongs. If this is the case it can generally be assumed that the band strip will also be cut to the correct length. Thus it may be possible to dispense with the detector group 30 between the bundle strip and the band supply rollers, particularly as the band supply rollers are generally fitted with a monitoring device which gives a timely indication when the supply of band paper is running out.

The hereindescribed automatic conmverting apparatus generally operates with a programme control and has a visual display unit for the visual display of information. In this case it is also advantageous to use this visual display unit to display a band fault whereby for example a code can designate the relevant banding device. A selector switch is then preferably provided, with which the banding device which requires to be set in operation for the purpose of a late banding operation can be pre-selected, whereupon this banding device can be operated by actuating a push button and then the whole apparatus can be restarted.

By the measures according to the invention, i.e. carrying out a late banding operation immediately after detection of a banding fault at the relevant location without further manipulation of the bundle strip, is ensured that the operating capacity provided, i.e. the work rating of the apparatus, is practically unaffected even when banding failures occur.

What is claimed is:

1. Apparatus for automatically converting piles of freshly printed sheets of multiple numbered value tokens, in particular sheets of banknotes, into packs of banded bundles of consecutively numbered value tokens, the apparatus comprising a strip cutting device for cutting the piles into bundle strips, a banding station for the bundle strips comprising as many banding devices, arranged adjacent one another and operating in synchronism, as there are individual value tokens per strip, a bundle cutting device for cutting the banded bundle strips into banded bundles, an intermediate store in which bundles containing value tokens of the same series are piled into bundle packs, and advancing and transporting devices for the piles, bundle strips and bundles, wherein the banding station is associated with a band detector system, which is adapted to sense an absent band or a faulty banding operation and, before further movement of the respective bundle strip, to emit a fault signal whereby the fault position is identified and the operation of the section of apparatus including the cutting devices, the banding station, the intermediate store and the aforementioned advancing and transporting devices is interrupted, and wherein each banding device is individually operable and is provided for that purpose with an actuating element which after the occurrence of a fault signal is actuatable manually or automatically for the purpose of carrying out an individual late banding operation by means of the respective banding device.

2. Apparatus according to claim 1, wherein each banding device has at least one respective band detector for monitoring the correct supply of the band and a respective further detector which monitors folding over of the ends of the band guided under or over the bundle strip and severed.

3. Apparatus according to claim 1, wherein preceding the strip cutting device are two slitting devices for simultaneously trimming the two longitudinal edges of the sheets of each pile and these slitting devices are likewise turned off on occurrence of a fault signal.

* * * * *